United States Patent [19]

Mainetti

[11] 4,157,782

[45] Jun. 12, 1979

[54] CLOTHES HANGER

[75] Inventor: Mario Mainetti, Valdagno, Italy

[73] Assignee: Mainetti S.A., Seclin, France

[21] Appl. No.: 897,015

[22] Filed: Apr. 17, 1978

[30] Foreign Application Priority Data

Apr. 18, 1977 [IT] Italy ..... 84124 A/77

[51] Int. Cl.[2] ..... A47J 51/14

[52] U.S. Cl. ..... 223/96

[58] Field of Search ..... 223/91, 93, 96; 24/81 R, 260, 251

[56] References Cited

U.S. PATENT DOCUMENTS

| | | | |
|---|---|---|---|
| 1,716,985 | 6/1929 | Spear | 223/93 |
| 2,382,459 | 8/1945 | Wollin | 223/96 |
| 2,408,344 | 9/1946 | Scurrah | 223/91 |
| 2,455,258 | 11/1948 | Levitin | 223/91 X |
| 2,522,595 | 9/1950 | Bacica | 223/91 |
| 3,471,069 | 10/1969 | Simon | 223/91 |

FOREIGN PATENT DOCUMENTS

| | | | |
|---|---|---|---|
| 6618260 | 7/1967 | Netherlands | 24/81 R |

*Primary Examiner*—George H. Krizmanich
*Attorney, Agent, or Firm*—D. Paul Weaver

[57] ABSTRACT

A clothes hanger particularly for skirts or trousers embodies a cross member provided near its center with a suspension hook. Near opposite ends, the cross member carries two articulated clamps for gripping suspended clothes. Top extensions of the clamps receive between them wedging elements carried by flexible arms attached to the cross member and held normally out of engagement with the clamps until the flexible arms are depressed. The clamping action of each clamp can be independently regulated. Simplicity and economy of manufacturing are featured.

11 Claims, 5 Drawing Figures

Fig. 1.
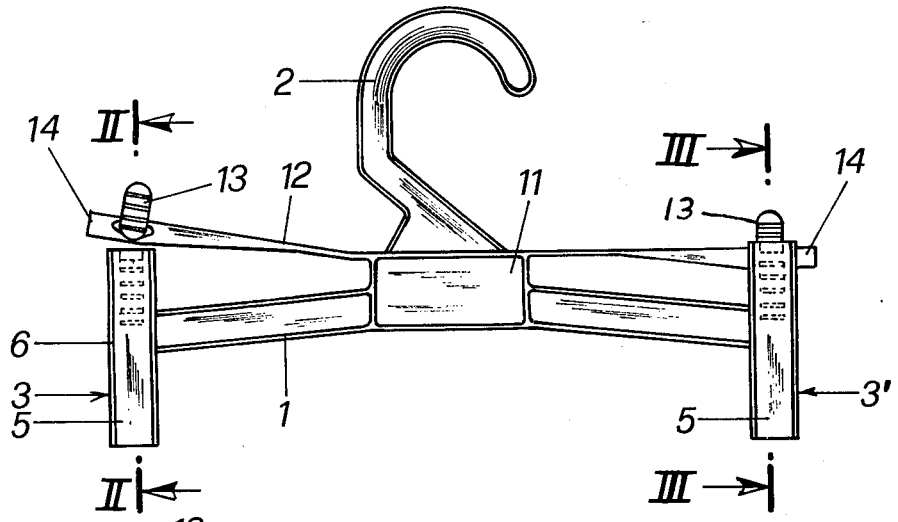
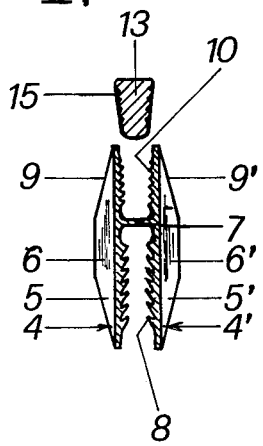
Fig. 2.
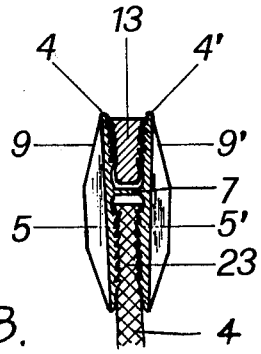
Fig. 3.
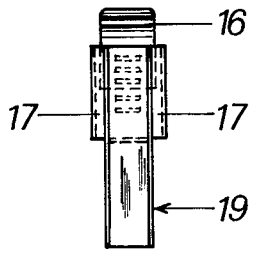
Fig. 4.
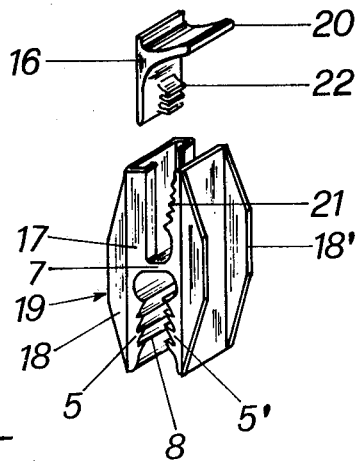
Fig. 5.

CLOTHES HANGER

BACKGROUND OF THE INVENTION

Various types of clothes hangers including hangers for skirts and trousers are known in the prior art. Such prior art hangers may comprise a horizontal support or cross member provided at its ends with clamps to support garments in a hanging position.

Customarily, the gripping action of the garment clamps depends on the force of springs acting on jaws of the clamps. Relatively weak springs protect the clothes from damage, but may provide insufficient clamping force to support thin layers of clothing, particularly during transport where the clothing is subjected to bumps and bounces. On the other hand, strong springs may avoid this drawback but may also damage the clothing, particularly thick layers of clothing.

Springs having adjustable forces are known in the prior art but their use in a garment hanger causes an increase in production cost far above acceptable ranges from a practical standpoint.

With the above deficiencies of the prior art in mind, the present invention seeks to provide a very simple and economical clothes hanger which can securely hold garments having a wide range of thicknesses with uniform effectiveness.

A more specific object of the invention is to provide a clothes hanger for skirts and trousers in which the adjusting of the clamps may be obtained in a very simple, direct and quick manner, at the same moment when the clothes are introduced between the claws of the clamps.

Another object of the invention is to provide a clothes hanger of very low cost and therefore likely to be widely accepted in the marketplace.

Other features and advantages of the invention will become apparent during the course of the following detailed description.

SUMMARY OF THE INVENTION

A hanger particularly for skirts and trousers is molded as a unit from plastics material and comprises a cross member having a central suspension hook. Articulated clamps having opposing jaws are carried by opposite ends of the cross member and the clamps have upper extensions above the cross member which receive wedge or spreader elements carried by the ends of yielding arms joined with the cross member near opposite sides of the suspension hook. The clamps are individually adjustable in their gripping action according to the depth of engagement of the spreader elements between their upper extensions.

BRIEF DESCRIPTION OF THE DRAWINGS

FIG. 1 is a side elevation of a clothes hanger according to the invention.

FIG. 2 is a transverse vertical section taken on line 2—2 of FIG. 1.

FIG. 3 is a similar section taken on line 3—3 of FIG. 1.

FIG. 4 is a front elevational view of a modified form of clamp.

FIG. 5 is an exploded perspective view of the same.

DETAILED DESCRIPTION

Referring to the drawings in detail, wherein like numerals designate like parts, the numeral 1 designates a cross member or bar forming the body portion of the garment hanger and provided at its longitudinal center with a suspension hook 2, and at its opposite ends with clamps 3, 3' to hold clothing 4, such as skirt or trousers, suspended from the hanger.

Each clamp 3, 3' has a pair of opposed claws 5, 5' extending below the cross member 1 and strengthened by longitudinal ribs 6. The claws 5, 5' are joined near the middle of each clamp by a thin elastic plate or web 7, which forms an element of articulation between the claws and causes them to return to their position of rest shown in FIG. 2.

The portions of the claws 5, 5' below the web 7 have saw-like teeth 8 thereon, and so arranged as to hinder stripping of the clothing 4 downwardly from the clamp. Above the web 7, each clamp has jaw portions or arms 9, 9' provided on their inner opposing faces with preferably triangular teeth 10, or knurling.

Two thin flexible bars 12 extend from the central body portion 11 of the hanger and each bar 12 carries near its free end a spreader or wedging element 13 fixedly secured thereto. Unless downward pressure is exerted on the springlike bars 12, the elements 13 lie above the two clamps 3, 3' in a position ready for entry between the arms 9, 9'. The wedge-like elements 13 have downwardly converging sides 15, knurled or toothed, in opposing relationship to the teeth 10 of arms 9, 9'. Preferably, to increase the wedging action of elements 13, the opposing toothed sides of the arms 9, 9' are slightly divergent upwardly.

As shown in FIG. 1, each arm 12 extends somewhat outwardly of the spreading or wedging element 13 to form a projection 14 which overhangs the outward side of the clamp 3 or 3'.

The above-described garment hanger is preferably produced in a single piece by injection molding of plastics, which minimizes manufacturing costs and eliminates the need for any assembling of parts.

It is also feasible to replace the molded plastics hook 2 with a metallic hook by techniques well known in the art.

The clothes hanger operates as follows:

The arms 12, unless manually depressed, hold the spreader elements 13 disengaged from the arms 9, 9' of each clamp, the claws 5, 5' of which consequently remain in their rest positions due to the memory of the elastic plates 7, as shown in FIG. 2.

When an article of clothing 4 is to be suspended from the hanger, such as a pair of trousers, the trouser bottoms are inserted between the claws 5, 5' and thereafter, by a simple operation carried out with one finger, the spreader elements 13 are forced downwardly between the arms 9, 9'.

The thinner the thickness of the clothing 4, the closer together the claws 5, 5' need to be moved to clamp the clothes, and the deeper the insertion of the elements 13 between the arms 9, 9' is necessary to spread such arms sufficiently. The end projections 14 assist in the engagement of the elements 13 to the necessary depths between the arms 9, 9' even to their fullest positions of engagement shown in FIG. 3. The projections 14 allow greater leverage to be placed on the elements 13 than would otherwise be possible by direct finger pressure on the spreading elements by the operator.

Once the desired clamping effect with the clamps 3, 3' has been achieved, the latter hinder slipping out of the clothing 4 because of the arrangement of the teeth 8 and simultaneously the elements 13 prevent any releasing of the clothes by the claws 5, 5'. Likewise, the spreader elements 13 will not accidentally dislodge from the arms 9, 9' due to the coaction between the teeth 10 and 15. The elements 13 will only be dislodged from between the arms 9, 9' due to positive action by the user causing such disengagement.

It will be appreciated that the clothes hanger according to this invention has the following advantages:

(1) An adjustable clamping action, according to the thickness of the piece of clothes 4 to be suspended.

(2) The fact that said adjustment may be achieved in a very simple and quick manner, at the same moment when it is required, i.e. directly on the piece of clothes 4 to be suspended.

(3) The fact that the clamping action of clamps 3, 3' may be adjusted independently from each other; each clamp being adjusted to the thickness of the relevant portion of the piece of clothes, ths overcoming any possible local difference in the thickness of the piece of clothes.

(4) The fact that the above-mentioned advantages may be obtained with an article of a very low cost, thus likely to reach a very wide market segment.

According to a modification of the invention in FIGS. 4 and 5, the spreading element 16 is a separately formed piece, sliding between runners 17, grooved out of the internal surface of an arm 18 of each clamp 19, said spreading element 16 carrying an operating projection 20 and a toothed portion 22, which engages in a toothed portion 21 formed on the interior face of the other arm 18' of the same clamp. The two arms 18 and 18' preferably diverge slightly toward their upper ends when the clamp is at rest.

The clamp 19 functions in substantially the same manner described above for the clamps 3, 3', and the degree of clamping action is dependent on the extent of insertion of the element 16 between the two arms 18 and 18'. All other parts of the hanger, not shown, are substantially as described in the previous embodiment including the cross member 1 and suspension hook 2.

The embodiment of FIGS. 4 and 5 offers a further advantage, as the position of each clamp 19 is practically independent from the body 11 of the hanger, thus allowing the mounting of each clamp 19 on the cross member 1 as a freely mobile element so as to cover a higher range of clothing sizes.

It is to be understood that the forms of the invention herewith shown and described are to be taken as preferred examples of the same, that various changes in the shape, size and arrangement of parts may be resorted to, without departing from the spirit of the invention or scope of the subjoined claims.

I claim:

1. A clothes hanger comprising a cross member having a central suspension hook, a pair of clamps carried by opposite ends of the cross member and each having a pair of opposing claws in articulated relationship with arm extensions of the claws projecting above the points of articulation of the claws, a pair of flexible leaf spring elements connected with said cross member and extending thereabove and adjacent to the tops of said arm extensions, and a pair of rigid tapered spreading elements one for each clamp and engageable between the arm extensions of the clamps to thereby force the clamps into gripping engagement with an article of clothing inserted between said claws, said spreading elements being bodily mounted on said flexible leaf spring elements near free ends of the latter, and said clothes hanger formed as a unit from moldable material.

2. A clothes hanger as defined in claim 1, and the opposing faces of said claws being toothed to resist stripping of clothes from the claws.

3. A clothes hanger as defined in claim 1, and wherein the spreading elements are of wedge-like configuration and are knurled, the opposing faces of said arm extensions being knurled.

4. A clothes hanger as defined in claim 1, and the articulated relationship of said claws being provided by a flexible web extending between the claws and joining them in spaced relationship.

5. A clothes hanger as defined in claim 1, wherein an arm extension of each clamp is provided on its interior face with vertical runners for said spreading element, said spreading element engaging the interior face of the opposing arm extension of the clamp.

6. A clothes hanger as defined in claim 5, and wherein each spreading element carries a toothed portion which engages a mating toothed portion formed in the interior face of the opposing arm extension.

7. A clothes hanger as defined in claim 6, and wherein each spreading element carries a lateral operating projection.

8. A clothes hanger as defined in claim 1, wherein each clamp is movably mounted on said cross member.

9. A clothes hanger comprising a cross member having a central suspension hook, a pair of clamps carries by opposite ends of the cross member and each having a pair of opposing claws in articulated relationship with arm extensions of the claws projecting above the points of articulation of the claws, a pair of spreading elements one for each clamp engageable between said arm extensions of the clamps to thereby spread the arm extensions apart and draw said claws of the clamps together in gripping engagement on an article of clothing inserted between said claws, and flexible bars connected with said cross member and carrying said spreading elements near corresponding ends of the flexible bars and normally holding the spreading elements free of engagement with said arm extensions and being yieldable to allow the spreading elements to engage between the arm extensions of said clamps.

10. A clothes hanger as defined in claim 9, and said flexible bars extending longitudinally outwardly of the spreading elements to form end projections on the flexible bars which overhang the outer lateral edges of said clamps.

11. A clothes hanger as defined in claim 10, and said cross member, clamps, flexible bars and spreading elements molded as an integral unit from plastics material.

* * * * *